United States Patent [19]

Oide

[11] 4,341,532

[45] Jul. 27, 1982

[54] LAMINATED ROTARY GRINDER AND METHOD OF FABRICATION

[75] Inventor: Kunimasa Oide, Kawanishi, Japan

[73] Assignee: Daichiku Co., Ltd., Hyogo, Japan

[21] Appl. No.: 869,374

[22] Filed: Jan. 13, 1978

[30] Foreign Application Priority Data

Jan. 18, 1977 [JP] Japan ..... 52-4798
Jun. 18, 1977 [JP] Japan ..... 52-72363

[51] Int. Cl.[3] ..... B24D 11/00

[52] U.S. Cl. ..... 51/297; 51/207; 51/293; 51/298

[58] Field of Search ..... 51/293, 297, 298, 207

[56] References Cited

U.S. PATENT DOCUMENTS

| | | | |
|---|---|---|---|
| 1,045,016 | 11/1912 | George | 51/207 |
| 1,655,371 | 1/1928 | Keay | 51/297 |
| 2,242,877 | 5/1941 | Albertson | 51/297 |
| 2,393,267 | 1/1946 | Robie et al. | 51/297 |
| 2,712,205 | 7/1955 | Valette | 51/207 |
| 2,763,105 | 9/1956 | Feeley | 51/298 |

*Primary Examiner*—Donald E. Czaja
*Assistant Examiner*—W. Thompson
*Attorney, Agent, or Firm*—Koda and Androlia

[57] ABSTRACT

A laminated rotary grinder including a parallity of thin grinding stone discs laminated together in an axial direction wherein the thickness of each of the discs is in the range of one to ten mm, the width of each space between each of the laminated discs is substantially within the range of 0.05 to 4 mm and the thickness of each of the discs is always greater than the space between discs.

15 Claims, 16 Drawing Figures

FIG.1
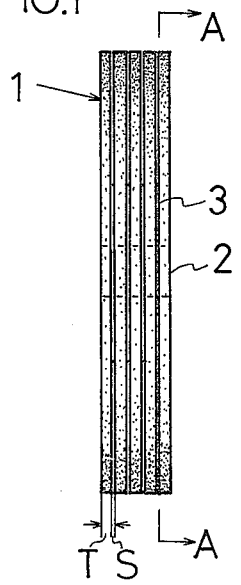
FIG.2
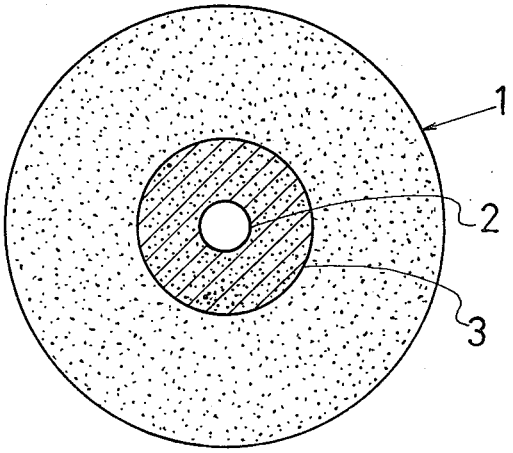
FIG.3
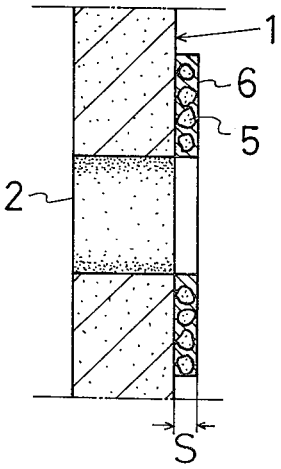
FIG4
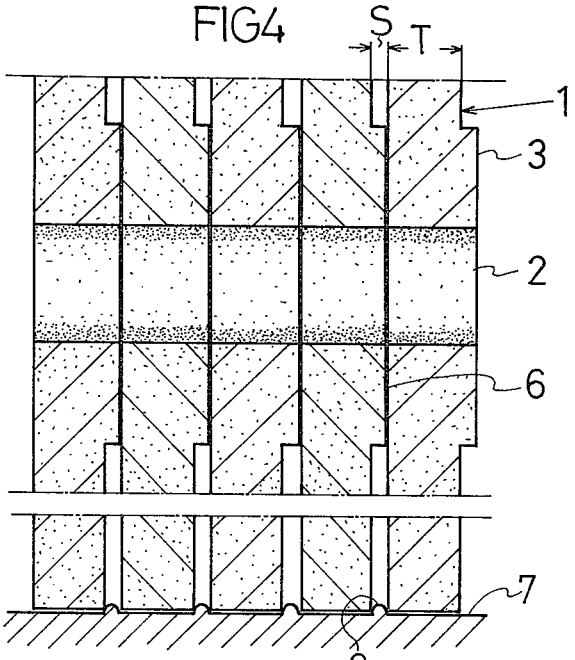
FIG.5

LAMINATED ROTARY GRINDER AND METHOD OF FABRICATION

BACKGROUND OF THE INVENTION

1. Field of Invention

The present invention relates to rotary grinders and more particularly to laminated rotary grinders and their fabrication.

2. Prior Art

Rotary grinders for abrading metal, bricks, stones and the like are well known in the art. Such rotary grinders typically consist of a single grindstone with a thickness in excess of one inch (2.54 cm). It is also known in the art that a grinder comprising thin laminated grindstone discs produces better grinding efficiency than one made up of a single thick grindstone. This is disclosed, for example, in U.S. Pat. Nos. 2,396,505, 3,023,551, or 3,653,858.

The superior efficiency of laminated rotary grinders is due to the fact that currents of air occur in the space gaps between the thin grindstone disc powdery dust from clogging the grindstone surfaces. The air currents also increase the heat dissipation such that damage to blades and other materials being ground due to generated heat is avoided and the sharpness of such blades can always be maintained. Moreover, the side slipping action of the grinder to eliminate ridges left on the grinding surface by the grinder also contributes to improved grinding efficiency. However, while the prior art laminated grinders are more efficient than the single type rotary grinders, the peak efficiency of such grinders has not been achieved by the prior art laminated rotary grinders.

SUMMARY OF THE INVENTION

Accordingly it is the general object of the present invention to provide an improved laminated rotary grinder.

It is another object of the present invention to provide a fabrication method for an improved laminated rotary grinder.

It is still another object of the present invention to provide a laminated rotary grinder with high efficiency.

In keeping with the principles of the present invention the objects are accomplished by a unique laminated rotary grinder including a polarity of thin grinding stone discs laminated together in an axial direction wherein the thickness of each disc is within a predetermined range, the width of the space between each disc is within another predetermined range and the thickness of each disc is always greater than the spacing between discs. In one embodiment the spacing is accomplished by means of a boss provided on each disc. In a second embodiment the spacing is accomplished by means of a mixing inorganic granular particles of uniform diameter with an adhesive and using the mixture of the adhesive and uniform inorganic granular particles to bond the discs together.

BRIEF DESCRIPTION OF THE DRAWINGS

The above described features and objects will become more apparent by reference to the following description taken in conjunction with the accompanying drawings wherein like referenced numerals denote like elements and wherein:

FIG. 1 is a side view of a laminated rotary grinder in accordance with the teachings of the present invention;

FIG. 2 is a cross-sectional view taken along the lines A—A of FIG. 1;

FIGS. 3 and 4 are partial cross-sections illustrating shapes for the boss members provided on the disc of a rotary grinder in accordance with the teachings of the present invention;

FIG. 5 is a partial cross-sectional view illustrating the grinding surface of the laminated rotary grinder of FIG. 1;

DETAILED DESCRIPTION OF THE INVENTION

Figure 6:
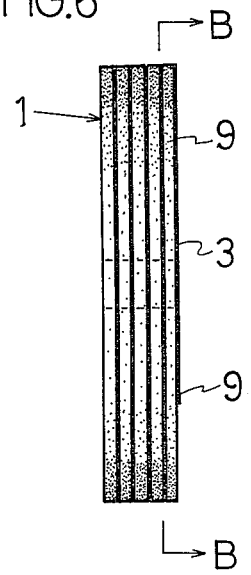
FIG. 6 is a side view of a laminated rotary grinder in accordance with the teachings of the present invention illustrating the spaces between the discs created by radially disposed ribs.

Normally, the thickness of a rotary grinder is over one inch (2.54 cm), and the thickness T of a grinder used for grinding the entire surface of an object by side slipping must not be over 1/50 of the diameter D of the object, i.e., $$T > D/50 \quad (1)$$

For example, when D equals 150 mm, $T > 3$ mm; and when D equals 200 mm, $T > 4$ mm.

Presently, however, rotary grinders of such thinness are not usually used other than for processing grooves or holes at fixed intervals on the grinding surface. For surface grinders, some grinders are found to comprise several discs merely sealed together, but no significant result can be expected from such grinders although they have a slightly better grinding efficiency than a monolithic grinder. However, it has been found that a significant improvement in grinding is achieved by providing even a slight space between the laminated rotary disc, even if such space is as narrow as 0.05 mm. Wider spaces, on the other hand, result in many ridges being formed on the surface and attempts to break away such ridges by side slipping may at times not only cause damage to the rotary grinder but also bring about a significantly lower grinding efficiency. Tests results show that the most favorable width of the space between discs is around 1 mm and extends up to 2 mm. Signs of decreased efficiency begin to appear at about 3 mm and 4 mm, substantially the limit of the space between discs. The thickness T of the grindstone disc relative to the diameter D should be as thin as possible within the scope of the above given equation (1), the most favorable thickness T being in the range of 1 to 10 mm. A thickness for the disc in excess of 10 mm appears to lower the overall efficiency. Thus, the measurements used in the present invention are set within 1 to 10 mm for the disc thickness and within 0.05 to 4 mm for the laminar spacing between the discs. The reasons for these limiting values will be discussed later in conjunction with measured data.

The rotary grinder of the present invention comprises from 3 to 10 and normally 4 to 6 thin grindstones discs laminated together with a slight space therein between and bonded together to prevent any sliding between the discs during grinding operations. An effective fabrication method is described hereinbelow.

Referring to FIG. 2, which shows a cross-sectional view along the lines A—A of FIG. 1, a boss member 3 is provided in the central area of each grindstone disc around a shaft opening 2. The space between discs is maintained by this boss 3. As can be seen in FIG. 3, the boss 3 may be formed by applying a mixture of thermosetting adhesive 6 such as phenol resin and a suitable amount of granular particles 5 such as grindstone particles, sand and the like having a uniform diameter and thereafter by compressing the discs, the particles are distributed in one layer to achieve the desired space with the width equal to the diameter of the particles. Thus, by (i) applying the grain-containing binder to the central area of the already shaped grindstone disc, (ii) stacking and compressing the discs and (iii) firing the assembly, a laminated rotary grinder having a desired space S is obtainable. This technique allows flexibility in the adjustment of spaces within the range of 0.05 to 4 mm. Furthermore, since the discs are bonded together during firing, the discs are strongly laminated together. This technique is preferable to one using spacers of suitable material to create spaces in the range of 0.05 to 4 mm.

FIG. 4 shows grindstone disc with projecting boss members which are formed during the shaping of the discs by a pressed method. In this case, first adhesive is applied to the surface of the boss 3 then an appropriate number of discs are pressed together and finally the unit is fired to form a bonded product. Although this method is a little inconvenient in that molds of different sizes must be fabricated depending on the size of the space desired, it has application in the fabrication of grindstone discs having radial ribs 9 to be described herein later. The projecting boss may either be provided on one surface or both surfaces of the disc. In the latter case, only discs with projecting bosses may be laminated, but those laminated in combination with flat discs and bonded together also meet the above described requirements. Moreover, the shape of the projecting boss 3 may be polygonal, triangular, square, hexagonal, etc., in addition to being circular so long as it allows currents of air.

As set forth above, because the rotary grinder has thin (1 to 10 mm) discs and narrow (0.05 to 4 mm) spaces in between the discs and because of the small contact surface, the load per square area will be greater. Also because the grinder has many edges, it is possible to grind objects rapidly and deeply, as shown in FIG. 5. The ridges left by the spaces between the discs, can be broken away or cut away rapidly by side slipping the grinder horizontally if the ridges are narrow enough thereby significantly curtailing the grinding time. The width of these ridges 8 are determined by the width of the spaces S between the discs. Therefore, for grinding metals, particularly stainless steel, soft iron and the like, a spacing S in the range of 1 to 0.05 mm is preferable. For soft metal such as brass aluminum and the like, a spacing S in the range of 0.1 to 2 mm is preferable. For brittle materials such as fire resistant brick, a spacing S in the range of 0.05 to 4 mm is preferable. In the case of metals, the side slipping operation becomes difficult when the spacing S is in excess of 2 mm and as a result the grinding efficiency is lowered. In the case of fire resistant brick, a noticeable lowering of the grinding efficiency occurs when the spacing S is in excess of 4 mm. The basis for these limitations will be discussed infra.

Figure 7:
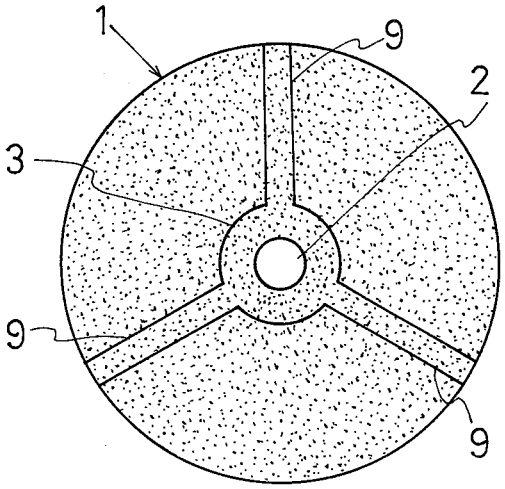
FIGS. 7 and 8 are cross-sectional views taken along the line B—B of FIG. 6 illustrating the shape of the radial ribs.
Figure 8:
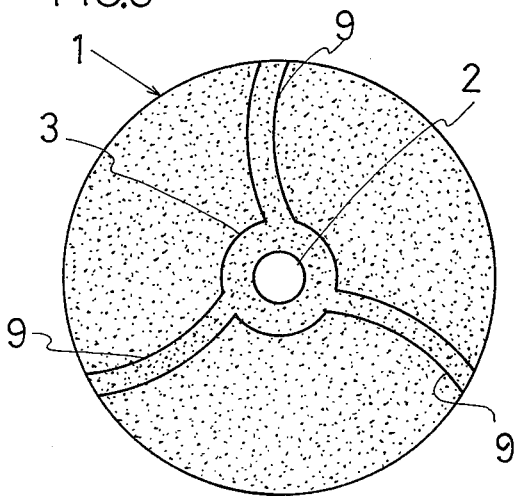

FIG. 6 is an overall side view of a grinder with ribs 9 radially extending from the projecting boss 3. The ribs 9 provide space between the disc. FIGS. 7 and 8 are cross-sections along the line B—B of FIG. 6 illustrating examples of radial ribs 9. In FIG. 7 is shown three straight ribs 9. In FIG. 8 is shown three curved ribs 9. One radial rib may suffice, but two to six ribs are prferable. Providing such ribs 9 works to break away the ridges 8 almost simultaneously as they are formed so that a side slipping action of the grinder is not necessary. Moreover, the radial ribs 9 function both as reinforcements for the discs and as spacers between the discs. Radial ribs also generate more air flow and thus provide unexpectedly great benefits.

As described above, the laminated grinder of the present invention is not merely a lamination of grindstone discs but the specific relationship which exists between the thickness T of each of the discs and the spaces between the discs significantly improve the grinding efficiency. The results of tests using various embodiments are described below.

Figure 9:
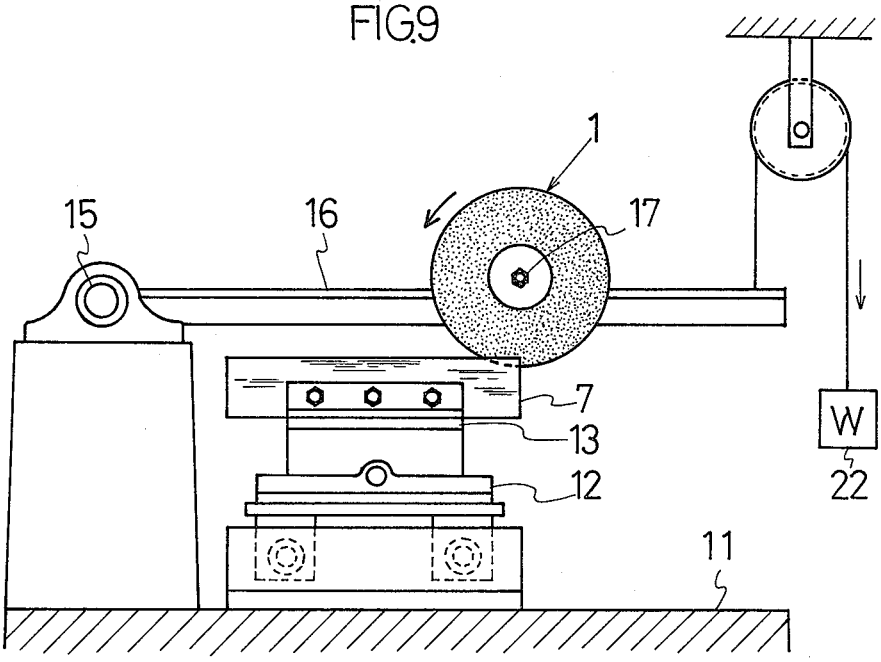
FIG. 9 is a plan view of a grinding tester used to measure grinding efficiencies.
Figure 10:
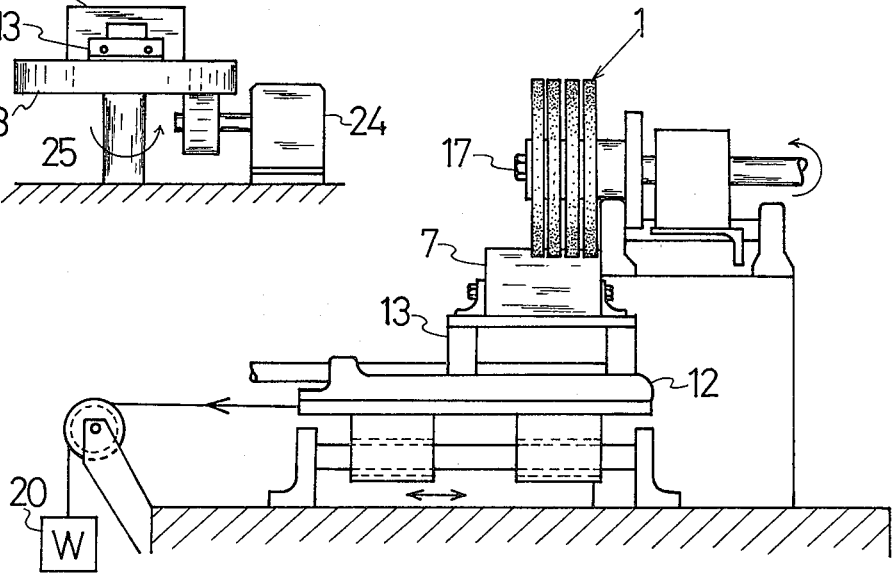
FIG. 10 is a side view of FIG. 9.

A grinding tester as shown in FIGS. 9 and 10 was built and using this tester, grinding experiments were conducted on various material.

The tester comprises a base 11, a sliding table 12 fixed to the top of the base 11, a fixing table 13 to which an object to be ground is fastened is provided atop the sliding table 12, an arm 16 moveably fixed to a fulcrum 15 atop a column provided at one end of base 11, and a grinder shaft 17 provided in the mid point of arm 16 and coupled to a motor by flexible wire and the like. A moveable load on the sliding table 12 is adjusted by a weight 20 and the load applied to the rotary grinder 1 is adjusted by a reduction weight 22 provided at the tip of the arm 16. Grinding efficiency during vertical feed is measured while the sliding table is stationary. Grinding efficiency during cross feed is measured by moving the sliding table 12 after a fixed depth of grinding has been ground.

Figure 11:
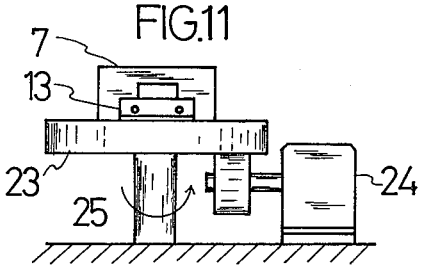
FIG. 11 is a side view of a rotating table tester.

Grinding efficiency of simultaneous vertical feed and cross feed is measured by placing an object to be ground on the fixing table 13 provided atop the rotating table 23 as shown in FIG. 11 so that the object is ground on a horizontal rotating level. The tester further comprises a decelerating motor 24 and a compression pulley 25. With an ordinary load the rotating table 23 rotates at a rate of 16 rpm but rotation stops when the table is overloaded. The rate of rotation of the rotary grinder is approximately 500 rpm.

The rotary grinders used in the experiment have the specifications given in Chart 1.

Chart 1

| Grinder No. | Grain Size | Outer Circum | Thickness | Comments |
|---|---|---|---|---|
| A-36-4 | A-36 | 150 | 4 | Alundum, for metals |
| A-24-2 | A-24 | 150 | 2 | Alundum, for metals |
| A-24-3 | " | " | 3 | Alundum, for metals |
| A-24-4 | " | " | 4 | Alundum, for metals |
| A-24-5 | " | " | 5 | Alundum, for metals |
| A-24-6 | " | " | 6 | Alundum, for metals |
| A-24-12 | " | " | 12 | Alundum, for metals |
| A-40-25 | A-40 | " | 25 | Alundum, for metals |
| A-24-4R | A-24 | " | 4 | With ribs (FIG. 7) |
| A-24-3G | " | " | 3 | Both surfaces reinforced with glass cord |
| C-24-4 | C-24 | " | 4 | Carborundum, for fire resistant brick |
| C-24-25 | " | " | 25 | Carborundum, for fire resistant brick |

Metals used for grinding were stainless steel, brass and aluminum. Also fire resistant brick such as alumina was used as the grinding material.

First in the test, the above given metals and fire resistant brick were subjected to grinding using grindstones discs of 4 mm thickness T and a spacing S between the discs ranging from 0.05 mm to 4 mm. The discs were fabricated together according to the technique shown in FIG. 3. The tests requirements were: (i) 4 to 6 grindstone discs each with a thickness of 4 mm to make a set such that the overall width of the grinder is approximately 25 mm; (ii) the grinder and the object for grinding are fixed to the sliding table 12 at appropriate positions on the tester as shown in FIGS. 10 and 11 (iii) a slot is ground using the grinder at a grinding speed of 500 rpm and a load of 5 kg; (iv) the grinding time is measured until the slot is 3 mm deep. The results are shown in Chart 2. The average value of 2 measurements is shown. Chart 2 results indicate that a significant reduction in grinding time is obtained even by a grinder whose spacing is practically non-existent, 0.05 mm, when compared with a grinder with no spaces at all. The most favorable and shortest grinding time was achieved for stainless steel when S equals 0.1 mm, for brass when S equals 3 mm, for aluminum when S equals 4 mm and for fire brick made of alumina when S equals 4 mm.

Chart 2

| space between discs S (mm) | Grinding Time t (in seconds) | | | | | |
|---|---|---|---|---|---|---|
| | Grinder composition | Stainless Steel | Copper | Aluminum | Grinder composition | High Alumina Brick |
| 0 | (A-40-25) × 1 | 276 | 31 | 94 | (C-24-25) × 1 | 273 |
| 0.05 | (A-24-4) × 6 | 137 | 20 | 63 | (C-24-4) × 6 | 209 |
| 0.1 | " | 124 | 21 | 42 | | — |
| 0.5 | (A-24-4) × 5 | 127 | 21 | 40 | (C-24-4) × 5 | 126 |
| 1.0 | " | 130 | 21 | 39 | " | 79 |
| 1.5 | " | 157 | 21 | 36 | " | 68 |
| 2.0 | " | 211 | 21 | 36 | " | 70 |
| 2.5 | (A-24-4) × 4 | — | 18 | 34 | | — |
| 3 | " | — | 15 | 32 | (C-24-4) × 4 | 63 |
| 4 | " | — | 16 | 30 | " | 60 |

Favorable results are shown for every grinding material when S equals 0.05 to 4 mm. The best results obtained with a small spacing S in the case of a rigid object such as stainless steel and by a greater spacing S in the case of brittle objects such as fire resistant brick. Ridges 8 left by the laminated grinder as shown in FIG. 5 tend to break away as the grinding continues if an appropriate space S between the disc is provided. Otherwise a smooth surface can be obtained by a slight side slipping motion of the grinder. Thus, if the side slipping time is taken into consideration the grinding times T of Chart 2 will be larger.

The results shown in Chart 3 are the time (tw in seconds) required to smooth the ridges shown in FIG. 5 by side slipping action using the device of FIG. 10. In this test objects were first ground to a depth of 3 mm and while the grinder continues to rotate, a 2 kg weight 20 was placed on the sliding table 12.

It is clear from Chart 3 that wire ridges required longer time but that narrower ridges are instantly smoothed within 1 second of slide slipping. From Chart 3 it is apparent that for rigid material such as stainless steel the spacing S should be less than 0.1 mm and for brittle material such as high alumina fire resistent brick the spacing S should be less than 1.5 mm.

Chart 3

| Space between discs S (mm) | Sideslipping Grind. Time (tw, in sec.) | | | |
|---|---|---|---|---|
| | Stainless Steel | Copper | Aluminum | High Alumina Brick |
| 0 | 0 | 0 | 0 | 0 |
| 0.05 | <1(0.35) | <1(0.05) | <1(0.4) | <1(0.1) |
| 0.1 | <1(0.7) | <1(0.15) | <1(0.8) | — |
| 0.5 | 1 | <1(0.35) | 1 | <1(0.3) |
| 1.0 | 5 | 2 | 4 | <1(0.9) |
| 1.5 | 27 | 5 | 10 | 2 |
| 2.0 | 121* | 8 | 14 | 4 |
| 2.5 | — | 14 | 25 | — |
| 3 | — | 27 | 53 | 23 |
| 4 | — | 41 | 79 | 126 |

Discs were damaged during sideslipping.

Results shown in chart 4 represent the overall grinding time and grinding efficiency. The overall grinding time is the time (ta in seconds) required to completely smooth the grinding surface by means of the vertical feed (chart 2) and side slipping (chart 3) expressed by the formula $$ta = t + ts \qquad (2)$$

grinding efficiency is 100 times the ratio of grinding time of conventional grinders whose spacing S equals zero over the grinding time.

Chart A

| Spaces between discs S (mm) | Grinding Efficiency & Overall Grinding Time (ta, in seconds) | | | |
|---|---|---|---|---|
| | Stainless Steel | Copper | Aluminum | Hialumina Brick |
| 0 | 100(276) | 100(31) | 100(94) | 100(273) |
| 0.05 | 201(137) | 155(20) | 149(63) | 130(209) |
| 0.1 | 220(125) | 148(21) | 219(43) | — |
| 0.5 | 216(128) | 148(21) | 230(41) | 216(126) |
| 1.0 | 204(135) | 135(23) | 214(44) | 341(80) |
| 1.5 | 150(184) | 119(26) | 204(46) | 390(70) |
| 2.0 | 83(332) | 107(29) | 188(50) | 370(74) |
| 2.5 | — | 97(32) | 159(59) | — |
| 3 | — | 74(42) | 111(85) | 317(86) |
| 4 | — | 54(57) | 86(109) | 147(186) |

Figure 12:
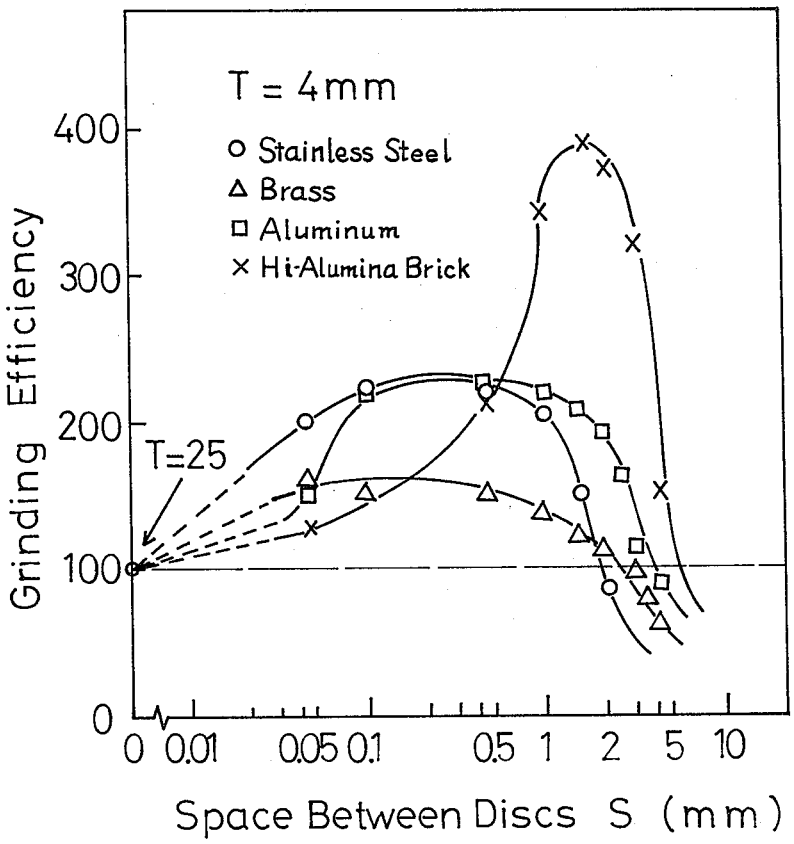
FIGS. 12 and 13 are graphs illustrating measured experimental results.
Figure 13:
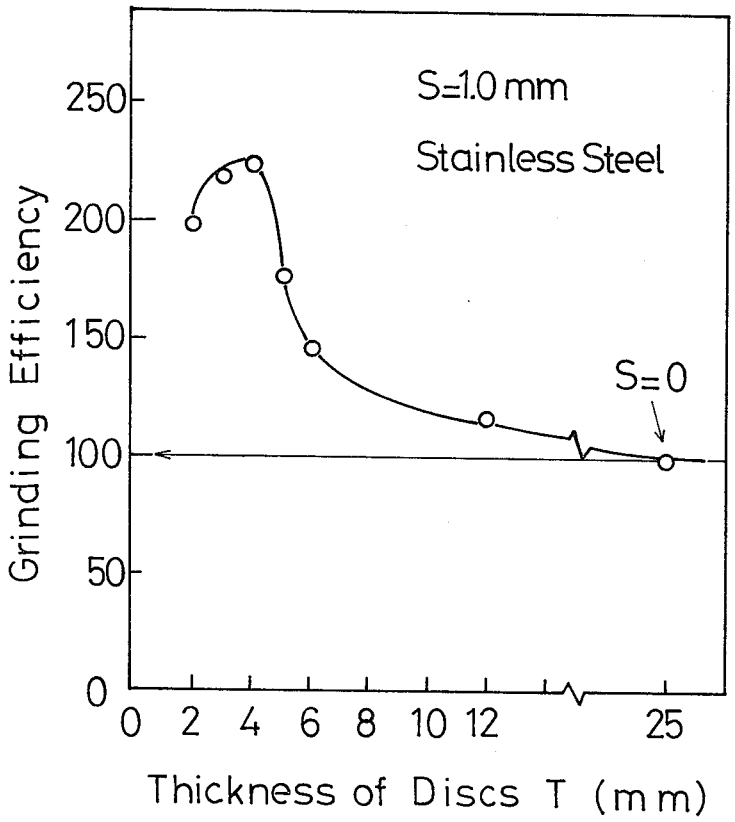

The relationship between the grinding efficiency and the space S between the discs is shown in FIG. 12.

As discussed above, these results indicate that a spacing S between 1 to 0.05 mm is most favorable for stainless steel. A spacing between 0.1 and 2 mm is the most favorable for brass and aluminum and a spacing S between 0.05 and 4 mm is the most favorable for fire resistant brick. As the space S exceeds 3 to 4 mm, grinding efficiency decreases even below the efficiency achieved by conventional one wheel grinders. This is because the side slipping time tw is longer as the S is wider, which in effect cancels out the increased efficiency obtained through vertical grinding. Although the attrition rate of the grinder is slightly greater than that of conventional grinders, the significant increase in grinding efficiency more than makes up for the cost of wear and tear on the grinder.

The next experiment dealt with the effects of the thickness T of each disc when used upon stainless steel, the hardest of the metal objects used in this experiment. In this experiment the rotating table 23 of FIG. 14 was utilized. Furthermore, the spacing S was fixed at 1 mm. The results of this experiment are shown in Chart 5 and FIG. 16. A maximum grinding efficiency was achieved when the thickness T was between 3 and 4 mm. When the thickness T exceeded 6 mm the effectiveness of the spacing S drops considerably and at a thickness T greater than 10 mm, practically no difference is observed. On the other hand, when the thickness T is less than 2 mm the discs lose their strength and are not practical. Thus the thickness T of each disc is preferably in the range of 1 to 10 mm as described hereinabove.

Chart 5

| Thickness of discs T (mm) | Grinder Composition (Grinder No.) × Number of Discs | Amount of Stainless Steel Ground (g/min) | Grinding Efficiency Stainless Steel |
|---|---|---|---|
| 25 | (A-24-25) × 1 | 2.4 | 100 |
| 12 | (A-24-12) × 2 | 2.8 | 117 |
| 6 | (A-24-6) × 4 | 3.5 | 146 |
| 5 | (A-24-5) × 4 | 4.3 | 177 |
| 4 | (A-24-4) × 5 | 5.4 | 225 |
| 3 | (A-24-3) × 7 | 5.2 | 215 |
| 2 | (A-40-2) × 8 | 4.8 | 198 |

While the pressure applied to the grinder in these experiments was uniformly 5 kg, distinct differences in grinding efficiency appear when a greater pressure of for example 7 kg, 10 kg, etc., is applied. Particularly in the case of stainless steel, a difference is noticeable around a spacing S equal to 0.1 mm. Thus, rapid generation of heat which occurs in a monolithic grinder with a thickness of approximately 25 mm and a spacing S equal to zero mm can be avoided even if a minute spacing is provided between the discs. Furthermore, the ribbed rotary grinder of FIG. 7 provides even better grinding efficiency because surface grinding is achieved without the need for side slipping action. The thickness of the ribs in these cases correspond to a spacing S of nearly 0.1 to 0.5 mm and as such at first glance the unit can be mistaken for an ordinary, conventional grinder.

When a grinder with reinforced glass cords disposed on both surfaces of each disc (A-24-30 in chart 1) was tested in the same manner as A-24-3, the glass fiber roughed badly to the extent that it could be used for polishing it was bound to be unsuitable for grinding. Thus, it is clear that the sharply exposed grains used in the laminated rotary grinder of the present invention is best suited for grinding.

As discussed above in relation to the use of a laminated grinder in accordance with the teachings of the present invention with stainless steel, when the thickness of the laminated discs becomes very thin the mechanical strength of the grinder is decreased. To overcome this difficulty, it has been recognized that instead of utilizing the boss and rib method of fabrication described in the embodiment above that it would be possible to increase the mechanical strength of the grinder by spreading the grain containing adhesive over the bonding surface between discs. It has further been recognized that an adhesive layer containing granular particles selectively fall off during the grinding process and thereby increase the grinding efficiency of the laminated grinder.

Figure 14:
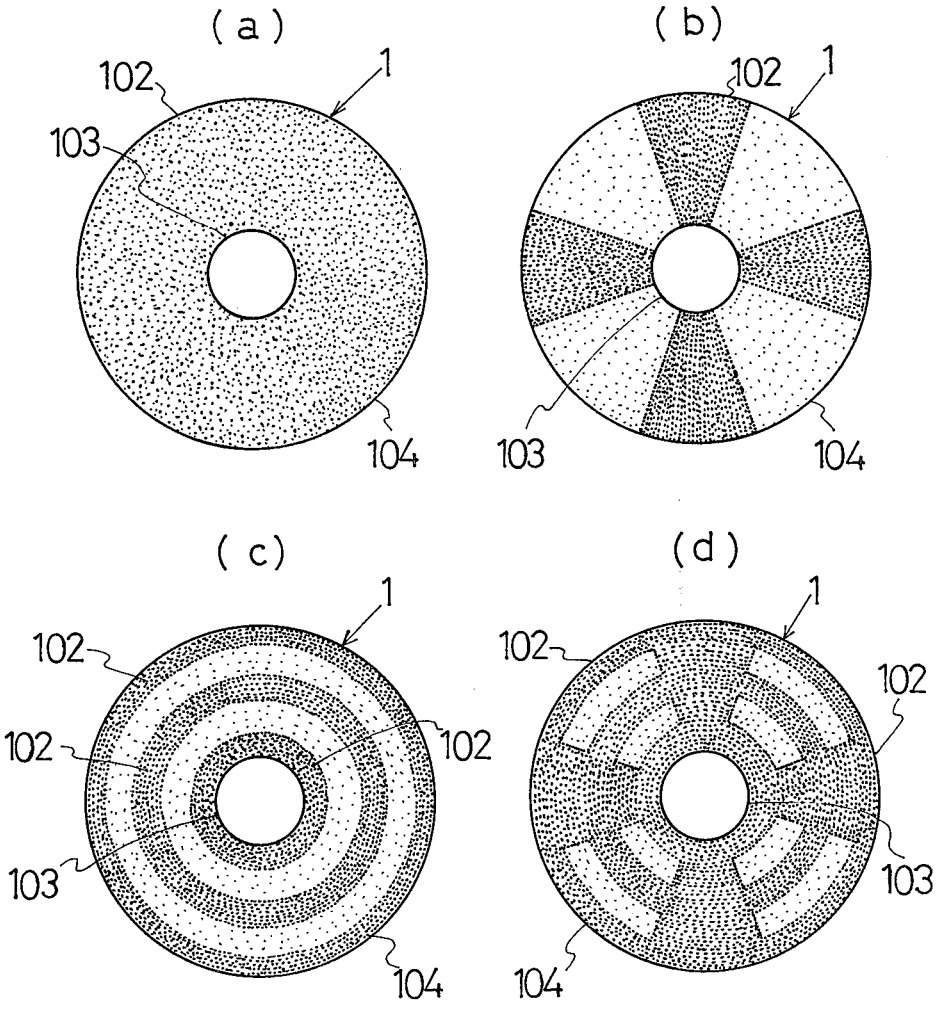
FIGS. 14*a* through 14*d* are plan views of grinding stone discs before lamination illustrating various ways in which the adhesive containing inorganic particles is disposed on the surface of the disc.
Figure 15:
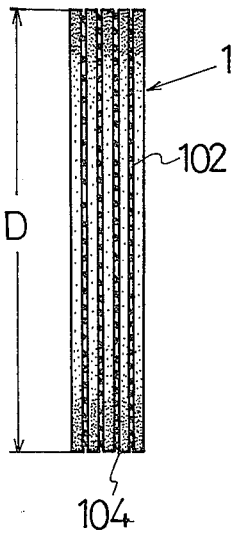
FIG. 15 is a side view of a laminated rotary grinder in accordance with the teachings of the present invention.
Figure 16:
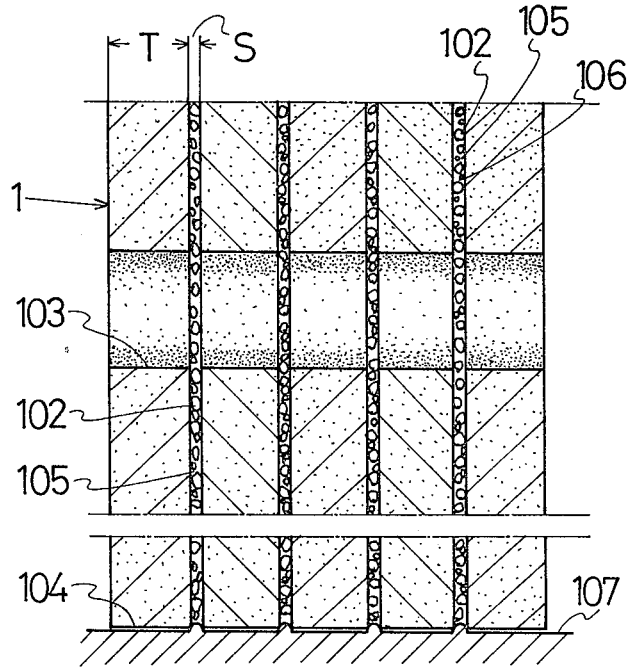
FIG. 16 is a partial cross-sectional view of the laminated rotary grinder in accordance with the teachings of the present invention.

Accordingly, a second embodiment of the laminated grinder in accordance with the teachings of the present invention is shown and described in relation to FIGS. 14 through 16.

In this second embodiment the laminated rotary grinder comprises an adhesive layer formed in the entire area or a part of the area extending from the inner circumference to the outer circumference of each laminor space. The adhesive layer consists of a mixture of an adhesive such as, for example, phenol resin and inorganic granular particles whose maximum, uniform diameter is equivalent to the desired width of the space S between discs.

Each of the thin grindstone discs to be laminated has a thickness T in the range of 1 to 10 mm and a diameter D in the range of 50 to 1,000 mm. Approximately 2 to 10 such discs are used to obtain the thickness of an ordinary rotary grinder. The above ranges are most suitable for medium (D) 150 to 200 mm to barge D equals 500 to 700 mm size laminated grinders which, when used for grinding aluminum, aluminum alloy and the like do not allow too much grinding dust to cling to the outer circumference of the grinder.

Each of the spaces S between the laminated discs has a width in the range of 0.05 to 10 mm and is preferably always narrower than the thickness T of the disc. If metal is to be ground, narrow spacing is preferable and if brittle objects such as fire resistant brick or stone are to be ground wide spacing is preferable. As described above, for metal objects, the best width is around 0.1 to 1 mm. In the present embodiment the width of the spaces S is regulated by the uniformity of the diameter of the inorganic granular particles, the maximum diameter being the width of the space between discs. In general the construction of the laminated rotary grinder of the second embodiment starts by mixing inorganic granular particles with an adhesive such as phenol resin. The mixture is then disposed or spread between the discs to form a layer which covers most of the surfaces between discs. The discs are then pressed together under pressure and fired and bonded.

As to the choice for the granular particles, grindstone grains are most convenient but ordinary inorganic mineral fragments such as quartz, feldspar, mica, magnetite, augite, hornblende and the like varying in size from course (to 2.5 mm) to medium (0.5 to 0.25 mm) and fine (0.25 to 0.01 mm) may be used. In addition, natural or artificial pumice grains may also be used. Such pumice grains as "Shirasu," which are obtained by firing and granulating "Shirasu-Balloon," are preferred materials because of their ability to retain grinding liquid such as grinding oil.

The adhesive mixture of inorganic granular particles and phenol resin made by mixing inorganic granular particles, such as grindstone particles, with powdered phenol resin and adding liquid phenol resin as a spreading agent. Examples of various compositions are shown in Chart 6. Numerals in Chart 6 represent weight.

Chart 6

| | Composition 1 | Composition 2 | Composition 3 |
|---|---|---|---|
| Grindstone particles | 5 | 6 | 7 |
| Powdered phenol resin | 4 | 3 | 2 |
| Liquid phenol resin | 1 | 1 | 1 |

The particles containing adhesive is applied or scattered onto the disc surface. The inorganic particles 1 or 2 may be scattered evenly over the entire disc surface as shown in FIG. 14*a*. They may be scattered radially from the disc inner circumference 103 towards the outer circumference 104 as shown in FIG. 14. They may also be scattered in a ring like formation as shown in FIG. 14*c*. In addition the particle containing adhesive may take on a combination of radial and ring formations such as shown in FIG. 14*d*.

Another useful way to apply the particle containing adhesive to the discs is to scatter the particles containing adhesive in spots over the entire surface area of the disc. The inorganic particles 102 are scattered over 30 to 100% of the disc surface. Two or more discs are slid together to create a space that is equivalent to the diameter of the particles. By applying a pressure than is weaker than the pressure used to form the disc, the entire configuration is fired at 180 to 200 degrees C. for from between two to five hours.

One example of this second embodiment of the laminated grinder is shown in FIG. 15, of which FIG. 16 is a partial cross-section. The spaces S between the discs, seen in FIG. 15, are formed as the adhesive resin contracts after the firing and are porous and lack strength. As shown in FIG. 16, the spaces are held at a fixed distance by the inorganic particles 102 and numerous cavaties 105 are present. Inorganic particles having smaller diameters 106 than the maximum diameter may be mixed in so long as there is a high density of inorganic particles having the required maximum diameter. Such a space can be seen in the right hand side of FIG. 16. In FIG. 16, the object to be ground 107 is made from a metal such as aluminum alloy.

The laminated rotary grinder of the above described fabrication may be quite large. Even a grinder with a diameter in excess of 500 mm is capable of producing products of uniform thickness because the spaces are even between the discs. Moreover, the use of inorganic particles between the discs brings about not only the effect of creating space but also provides an appropriately strong adhesive function such that ordinary mechanical impact cannot break the discs apart. The fact that the inorganic particles break away during grinding further contributes to an increased grinding efficiency. Grinding efficiency is also increased by disposing paraffin wax and the like in the cavity.

Chart 7 shows the results of comparative grinding tests using the laminated grinder of the present invention and a conventional commercially sold grinder. The former comprises six discs, each disc measuring in diameter 150 mm, in thickness 4 mm and a spacing between discs of 0.1 mm. The conventional commercially sold grinder is a single flat of 150 mm in diameter and 25 mm thick. Aluminum alloy and stainless steel were used for grinding. Grinding efficiency was determined at a circumferential speed of 1,630 m per minute by the amount of grinding achieved in a one minute duration with a 10 kg load. The adhesive agent, prepared according to the composition 1 of chart 5 using 0.1 mm, grindstone particles was evenly scattered (as shown in FIG. 1*a*) over approximately 70% of the surfaces of the A-24-150-4 discs.

Chart 7

| Grinder Category (A-24 grindstone (particles) | Aluminum Alloy Gring. Efficiency (g/min) | Amt of Wear (g/min) | Grind. Eff. (g/min) | Amt of Wear (g/min) |
|---|---|---|---|---|
| Embodiment 1 150mm × 4mm × 6 discs (S = 0.1 mm) | 6.7 | 3.0 | 7.3 | 1.8 |
| Embodiment 2 Same as Emb. 1 treated w/paraffin | 11.2 | 1.9 | 8.5 | 2.1 |
| Comparator 150mm × 25mm × 1 disc | 2.1 | 1.5 | 3.4 | 0.8 |

It is clear from the results of chart 7 that the grinding efficiencies of the embodiment 1 and 2 are superior to that of the conventional disc. It is also clear that burn was relatively minor during grinding and that performance is further improved by the paraffin treatment to the laminated disc rotary grinder.

As described hereinabove, the grinder of the present invention is not merely lamination of many spaced apart grindstone discs. Such spaced apart grinders have traditionally been used only for scraping multiple grooves in one sweep and not for surface grinding by side slipping as in the case of the grinder of the present invention. As can be seen in the experimental results of the present invention, the side slipping action by the grinder whose thin discs are laminated without any spacing between almost always cause damage to the grinder itself as well as cause injury to the operator such that side slipping maneuvers have been considered inappropriate. The grinder of the present invention in which grindstone discs of an appropriate thickness are laminated at an appropriate space interval truly demonstrates unexpectedly good results. In this respect the structure and fabrication methods disclosed hereinabove are exceedingly valuable.

It should be apparent to one skilled in the art that the above described embodiments are merely illustrative of but few of the many possible specific embodiments which represent the applications of the principles of the present invention. Numerous and varied other arrangements can be readily devised by those skilled in the art without departing from the spirit and scope of the present invention.

I claim:

1. A laminated rotary grinder comprising a plurality of thin grindstone discs laminated together with an adhesive in an axial direction with a fixed space between each disc wherein the thickness of each of said discs is between 1 and 10 mm, the width of the fixed space between laminated discs is between 0.05 and 4 mm and the thickness of each disc is always greater than the spacing between discs.

2. The laminated rotary grinder of claim 1, wherein approximately 3–10 of said discs having the thickness in the range of 1–10 mm are laminated and bonded by an adhesive layer disposed only in the vicinity of the core section of said discs.

3. The laminated rotary grinder of claim 1, wherein said discs having the thickness in the range of 1–10 mm are laminated and bonded by the use of spacers having the thickness in the range of 0.05–4 mm.

4. The laminated rotary grinder of claim 1, wherein a projection of 0.05–4 mm thickness is formed on at least one of the surfaces of each disc having the thickness in the range of 1–10 mm, said discs with said projections being laminated and bonded together.

5. The laminated rotary grinder of claim 1 wherein a projection of the between 0.05 and 4 mm thickness is formed on at least one of the surfaces of each disc and said discs with said projections being laminated together with at least one disc not having a projection.

6. The laminated rotary grinder of claim 4, wherein said projection is comprised of a circular or polygonal boss around the core section of said disc.

7. The laminated rotary grinder of claim 4, wherein said projection is comprised of several ribs radially extending from said boss around the core of said disc.

8. A method of fabricating a laminated rotary grinder comprising:

mixing inorganic particles of a uniform maximum diameter of between 0.05 and 4 mm with a thermosetting adhesive;

spreading the adhesive containing the inorganic particles on grindstone discs having a thickness of between 1 and 10 mm;

compressing the discs together to form a space between discs of between 0.05 and 4 mm; and firing the compressed discs to form a laminated rotary grinder.

9. A method of fabricating a laminated rotary grinder comprising:

forming a plurality of discs with a projection having a thickness in the range of 0.05 to 4 mm on at least one surface of the disc;

applying a thermosetting adhesive to the surface of the projection;

compressing the discs together; and firing the compressed discs to form a laminated rotary grinder.

10. A method according to claim 8 wherein said adhesive is spread only in the vicinity of a central section of said disc.

11. A method according to claim 8 wherein said adhesive is spread over 30 to 100% of the surface area of each disc.

12. A method according to claim 11 wherein said adhesive is spread in a plurality of rings about a center of said discs.

13. A method according to claim 11 wherein said adhesive is spread in a plurality of ribs extending from a center of said disc to a periphery of said disc.

14. A method according to claim 13 wherein said adhesive is further spread in a pluraity of rings about a center of said discs.

15. A laminated grinder according to claim 14 wherein said predetermined thickness is between 1 and 10 mm.

* * * * *